US011787222B1

(12) United States Patent
Lu et al.

(10) Patent No.: US 11,787,222 B1
(45) Date of Patent: Oct. 17, 2023

(54) TWO-COLOR PEN

(71) Applicant: Hainan Xingye Investment Co., Ltd., Haikou (CN)

(72) Inventors: Weifeng Lu, Shanghai (CN); Gongchi Lu, Shanghai (CN)

(73) Assignee: HAINAN XINGYE INVESTMENT CO., LTD., Haikou (CN)

( * ) Notice: Subject to any disclaimer, the term of this patent is extended or adjusted under 35 U.S.C. 154(b) by 0 days.

(21) Appl. No.: 18/207,679

(22) Filed: Jun. 9, 2023

(30) Foreign Application Priority Data

Feb. 27, 2023 (CN) ..... 202310176893.4
Feb. 27, 2023 (CN) ..... 202320339800.0

(51) Int. Cl.
*B43K 27/08* (2006.01)
*B43K 23/12* (2006.01)

(52) U.S. Cl.
CPC ..... *B43K 27/08* (2013.01); *B43K 23/12* (2013.01)

(58) Field of Classification Search
CPC ..... B41K 1/22; B43K 8/20; B05C 17/035; B05C 17/0352; B05C 17/0357
USPC ..... 401/44, 45, 47, 220
See application file for complete search history.

(56) References Cited

U.S. PATENT DOCUMENTS 5,435,245 A * 7/1995 Salisbury ..... B41K 1/38 101/328
2009/0031909 A1* 2/2009 Faber ..... B41K 1/006 101/329

FOREIGN PATENT DOCUMENTS

EP 2674058 A1 * 12/2013 ..... A45D 34/041

* cited by examiner

*Primary Examiner* — David P Angwin
*Assistant Examiner* — Bradley S Oliver
(74) *Attorney, Agent, or Firm* — Chun-Ming Shih; LANWAY IPR SERVICES

(57) ABSTRACT

A two-color pen includes a pen body, a roller and water supply components; the roller is rotatably provided at the head of the pen body; there is at least one pair of water supply components, a reset device for pushing the water supply components to be in contact with the roller is provided in the pen body; and the roller is provided with a transmission part which alternatively pushes two water supply components in pairs in the direction away from the roller in sequence. The reset device in the two-color pen can push the water supply components outputting different colors in the direction of the roller. When the roller is rolling, the transmission part provided on the roller can alternately push the two water supply components in pairs in the direction away from the roller in sequence, so that the water outlet ends of the two water supply components in pairs can alternately abut against the roller in sequence under the action of the reset device. In this way, the roller can draw lines or patterns with two colors, thus better meeting the use requirements of users.

13 Claims, 5 Drawing Sheets

TWO-COLOR PEN

TECHNICAL FIELD

The present disclosure belongs to the technical field of brushes, in particular relating to a two-color pen.

BACKGROUND

At present, there is a brush that can draw patterns directly in the market. The brush comprises a pen holder and a pattern roller. The pattern roller is rotatably installed at the front end of the pen holder. The rotation axis of the pattern roller is perpendicular to the axis of the pen holder. A winding core and a fiber head for providing pigments are provided in the pen holder. The tail end of the fiber head is inserted into the winding core to suck the pigments in the winding core, and the head end of the fiber head is in sliding contact with the pattern roller. When the pattern roller rolls on the paper, the fiber head can continuously rub the pigment onto the pattern roller, so that the pattern roller can continuously draw the pigment on the paper in the form of a pattern to complete the drawing of the pattern.

For example, in Chinese Utility Model Application No. 202222326757.2 entitled as "Continuous Line Brush", in the process of drawing lines, an ink drawing device always abuts against the pattern roller, so that the pattern roller can draw lines or patterns on paper.

However, the ink drawing device in the line drawing pen can only output pigment of one color to the pattern roller, so that lines or patterns drawn by the pattern roller are monochromatic, and beautiful lines or patterns cannot be drawn, which cannot meet the use requirements of users. Therefore, it is an urgent technical problem for those skilled in the art to invent a two-color pen that can draw lines or patterns with two colors.

SUMMARY

In order to solve the above problems in the prior art, the present disclosure provides a two-color pen to solve the technical problem in the prior art that the ink drawing device in the line drawing pen can only output pigment of one color to the pattern roller, so that lines or patterns drawn by the pattern roller are monochromatic, which cannot meet the use requirements of users.

The present disclosure is specifically implemented by the following technical scheme.

A two-color pen is provided, comprising a pen body, a roller and water supply components;

wherein the roller is rotatably provided at the head of the pen body;

there is at least one pair of water supply components, a reset device for pushing the water supply components to be in contact with the roller is provided in the pen body; and the roller is provided with a transmission part which alternatively pushes two water supply components in pairs in the direction away from the roller in sequence.

In order to better implement the present disclosure, the above structure is further optimized, there are two water supply components, the two water supply components are both provided in the pen body; the transmission part comprises two transmission parts A, the two transmission parts A are provided at both ends of the roller, respectively, and the two transmission parts A are in transmission connection with the two water supply components, respectively.

In order to better implement the present disclosure, the above structure is further optimized, the roller comprises a plurality of line drawing wheels, the transmission part comprises two transmission parts A and a plurality of transmission parts B, and the plurality of line drawing wheels are coaxially connected in sequence through the transmission parts B to form a line drawing part, the number of the line drawing wheels is equal to the number of pairs of the water supply component, and the two transmission parts A are provided at both ends of the line drawing part, respectively;

a plurality of pairs of the water supply components correspond to the positions of the plurality of line drawing wheels one by one, and the transmission parts B and the transmission parts B or the transmission parts A on both sides of the line drawing wheels are in transmission connection with two corresponding water supply components in pairs.

In order to better implement the present disclosure, the above structure is further optimized, the water supply component comprises a water storage device and a water diversion device; the water storage device is fixedly provided in the pen body, the water diversion device is slidably provided between the water storage device and the roller, and the water diversion end of the water diversion device is always connected with the water outlet end of the water storage device.

In order to better implement the present disclosure, the above structure is further optimized, the water diversion device comprises a water diversion seat and a water diversion core; the water diversion seat is slidably provided between the water storage device and the roller, the water diversion core is provided on the water diversion seat; one end of the water diversion seat facing the roller is provided with an extrusion bump which cooperates with the transmission part.

In order to better implement the present disclosure, the above structure is further optimized, the cross-sectional shape of the transmission part is fan-shaped, and the cambered surface of the transmission part is an extrusion surface that abuts against and cooperates with the extrusion bump.

In order to better implement the present disclosure, the above structure is further optimized, the reset device is a coil spring, a limiting protrusion is provided on the circumferential side wall of the water diversion seat, the limiting protrusion is located at one end of the water diversion seat close to the roller, the reset device is sleeved on the water diversion seat, one end of the reset device abuts against the head of the pen body, the other end of the reset device abuts against the limiting protrusion, and the reset device is always in a compressed state.

In order to better implement the present disclosure, the above structure is further optimized, the two-color pen further comprises a limiting base, wherein the limiting base is inserted into the head of the pen body, the limiting base is provided with a perforation at the position corresponding to the water diversion device, the water diversion end of the water diversion device is connected with the water storage device through the perforation, the end of the reset device far away from the roller abuts against the limiting base, and the roller is located at the end of the limiting base far away from the pen body.

In order to better implement the present disclosure, the above structure is further optimized, the two-color pen further comprises a fixed base, wherein the fixed base is inserted at one end of the limiting base far away from the pen body, two brackets are provided at one end of the fixed base far away from the limiting base, both ends of the roller are rotatably provided on the two brackets, respectively, and the water diversion device is slidably provided between the limiting base and the fixed base.

In order to better implement the present disclosure, the above structure is further optimized, the inner side wall of the fixed seat is provided with a chute, the length direction of the chute is parallel to the length direction of the pen body, the side wall of the water diversion device is provided with a protrusion matched with the chute, and the water diversion device is slidably provided in the fixed seat through the cooperation of the protrusion and the chute.

In order to better implement the present disclosure, the above structure is further optimized, the roller has a cylindrical structure, both ends of the roller are provided with rotating shafts, the roller is rotatably provided at the head of the pen body through the rotating shaft, and the axis of the rotating shaft is perpendicular to the length direction of the pen body.

In order to better implement the present disclosure, the above structure is further optimized, the two-color pen further comprises a pen cap for protecting the roller, and the pen cap is detachably sleeved on the head of the pen body.

In order to better implement the present disclosure, the above structure is further optimized, a pen point is provided at one end of the pen body far away from the roller, a water storage part is provided in the pen body, and the water diversion end of the pen point is connected with the water storage part.

To sum up, the two-color pen provided by the present disclosure has the following technical effects.

The reset device in the two-color pen can push the water supply components outputting different colors in the direction of the roller. When the roller is rolling, the transmission part provided on the roller can alternately push the two water supply components in pairs in the direction away from the roller in sequence, so that the water outlet ends of the two water supply components in pairs can alternately abut against the roller in sequence under the action of the reset device. In this way, the roller can draw lines or patterns with two colors, thus better meeting the use requirements of users.

BRIEF DESCRIPTION OF THE DRAWINGS

In order to explain the embodiments of the present disclosure or the technical schemes in the prior art more clearly, the drawings that need to be used in the description of the embodiments or the prior art will be briefly introduced hereinafter. Obviously, the drawings in the following description are only some embodiments of the present disclosure. For those skilled in the art, other drawings can be obtained according to these drawings without any creative effort.

Figure 1:
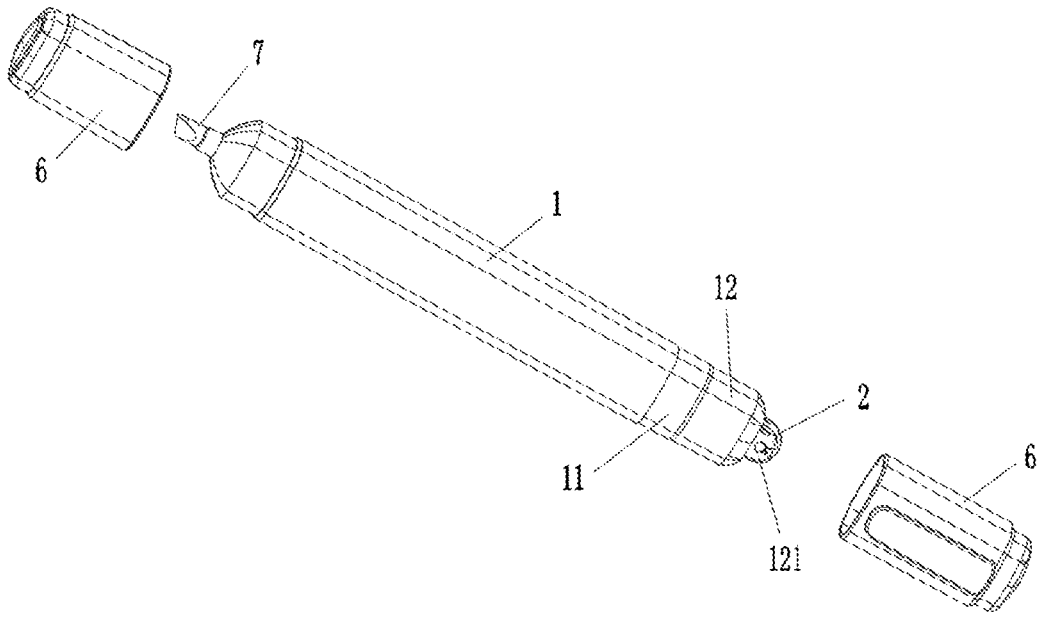
FIG. 1 is a schematic structural diagram of a two-color pen according to the present disclosure.

Reference numerals:

1. Pen body; 11. Limiting base; 12. Fixed seat; 121. Bracket; 122. Chute;

2. Roller; 21. Line drawing wheel; 22. Rotating shaft; 23. Transmission part A; 24. Transmission part B;

3. Water storage device;

4. Water diversion device; 41. Water diversion seat; 411. Extrusion bump; 412. Limiting protrusion;

42. Water diversion core;

5. Reset device;

6. Pen cap;

7. Pen point;

8. Water storage part.

DETAILED DESCRIPTION OF THE EMBODIMENTS

In order to make the object, technical scheme and advantages of the present disclosure clearer, the technical scheme of the present disclosure will be described in detail hereinafter. Obviously, the described embodiments are only part of the embodiments of the present disclosure, rather than all of the embodiments. Based on the embodiment of the present disclosure, all other embodiments obtained by those skilled in the art without any creative effort belong to the scope of protection of the present disclosure.

In the description of the present disclosure, it should be noted that, unless otherwise stated, "a plurality of" means two or more; the orientational or positional relationships indicated by the terms such as "up", "down", "left", "right", "inside", "outside", "front end", "back end", "head" and "tail" are based on the orientational or positional relationships shown in the drawings only for the convenience of describing the present disclosure and simplifying the description, rather than indicate or imply that the referred devices or elements must have a specific orientation, be constructed and operated in a specific orientation, and therefore should not be construed as limiting the present disclosure. In addition, the terms such as "first", "second" and "third" are only used for the purpose of description, and cannot be understood as indicating or implying relative importance.

In the description of the present disclosure, it should also be noted that unless otherwise specified and defined expressly, the terms such as "mount", "link" and "connect" should be understood broadly, for example, it can be fixed connection, detachable connection or integral connection; or mechanical connection or electrical connection; or direct connection or indirect connection through an intermediate medium. For those skilled in the art, the specific meanings of the above terms in the present disclosure can be understood according to specific situations.

Figure 2:
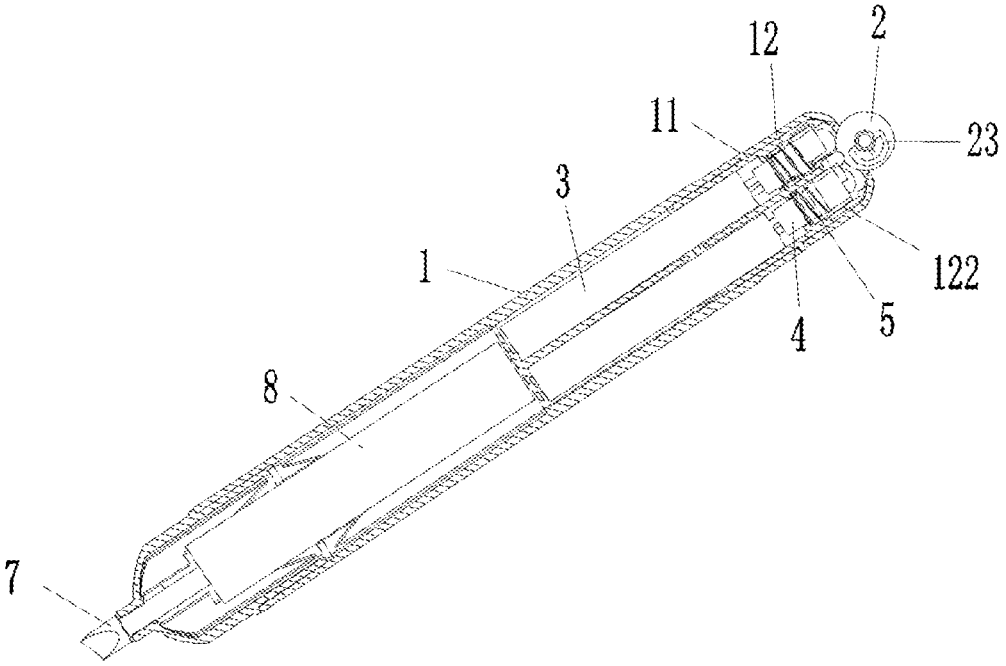
FIG. 2 is a cross-sectional view of a two-color pen according to the present disclosure.
Figure 3:
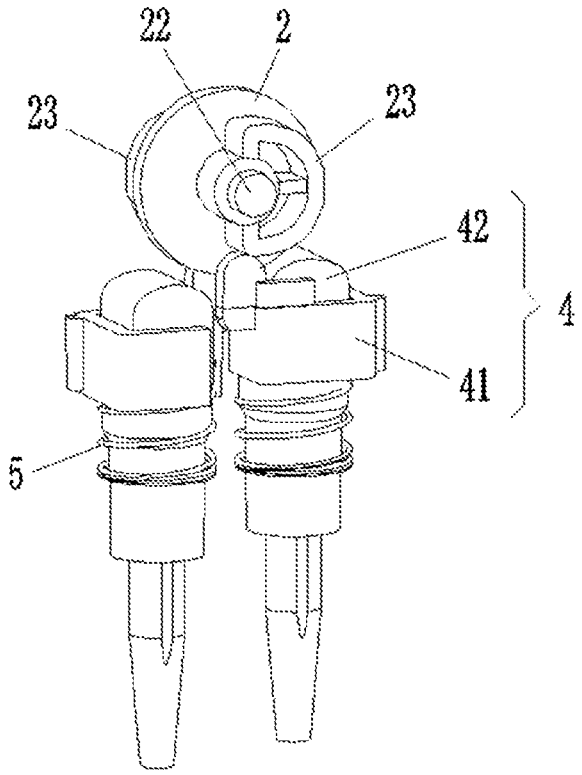
FIG. 3 is a state diagram of a roller of a two-color pen cooperated with a water diversion device according to Embodiment 1.
Figure 4:
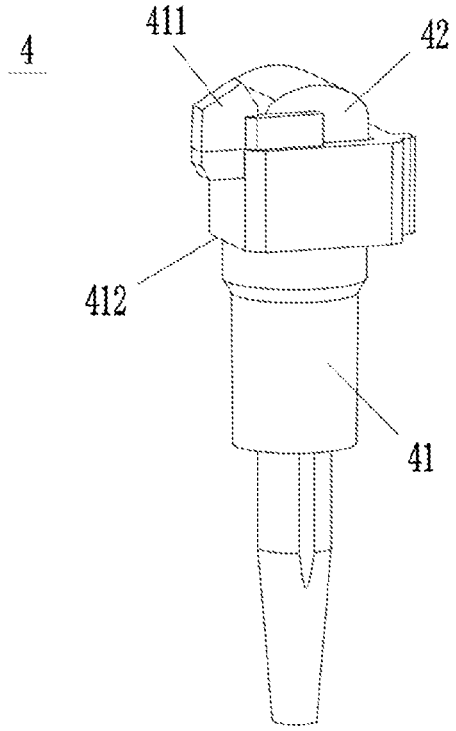
FIG. 4 is a schematic structural diagram of a water diversion device in a two-color pen according to the present disclosure.
Figure 5:
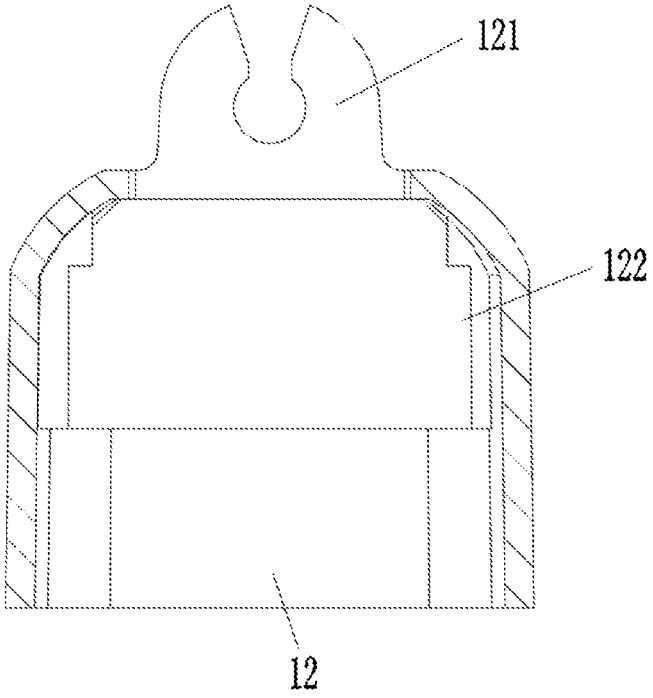
FIG. 5 is a cross-sectional view of a fixed part in a two-color pen according to the present disclosure.

Embodiment 1:

As shown in FIG. 1 to FIG. 5:

The present disclosure relates to a two-color pen, in particular to a single-line two-color pen, which comprises a pen body 1, a roller 2 and water supply components; wherein a cavity is provided in the pen body 1, the head of the pen body 1 is provided with an opening communicated with the cavity; and the roller 2 is rotatably provided at the head of the pen body 1, that is, at the opening of the pen body 1;

there is at least one pair of water supply components, a reset device 5 for pushing the water supply components to be in contact with the roller 2 is provided in the pen body 1;

and the roller 2 is provided with a transmission part which alternatively pushes two water supply components in pairs in the direction away from the roller 2 in sequence.

The two water supply components in pairs store pigments with different colors. The reset device 5 in the two-color pen can push the water supply components outputting different colors in the direction of the roller 2. When the roller 2 is rolling, the transmission part provided on the roller 2 can alternately push the two water supply components in pairs in the direction away from the roller in sequence, so that one of the water diversion devices 4 is pushed in the direction away from the roller 2 by the transmission part, and the water outlet ends of the two water supply components in pairs can alternately abut against the roller 2 in sequence under the action of the reset device 5. In this way, the roller 2 can draw lines or patterns with two colors (the two colors are intermittently distributed on the lines or patterns), thus better meeting the use requirements of users.

Specifically, there are two water supply components. The two water supply components are both slidably provided in the pen body 1, and the sliding direction of the water supply components is parallel to the length direction of the pen body 1.

The transmission part comprises two transmission parts A23. The two transmission parts A23 are provided at both ends of the roller 2, respectively, and the two transmission parts A23 are in transmission connection with the two water supply components, respectively, so that the two water supply components can be pushed in the direction away from the roller 2 in sequence by the two transmission parts A23, and the roller 2 can draw lines or patterns with two colors.

Preferably, the water supply component comprises a water storage device 3 and a water diversion device 4; wherein the water storage device 3 is fixedly provided in the pen body 1, the water diversion device 4 is slidably provided between the water storage device 3 and the roller 2, and the water diversion end of the water diversion device 4 is always connected with the water outlet end of the water storage device 3, so that the pigment in the water storage device 3 can be transported to the surface of the roller 2 by the water diversion device 4 and drawn at the required position by the roller 2.

Preferably, the water diversion device 4 comprises a water diversion seat 41 and a water diversion core 42; wherein the water diversion seat 41 is slidably provided between the water storage device 3 and the roller 2, the water diversion core 42 is provided on the water diversion seat 41; one end of the water diversion seat 41 facing the roller 2 is provided with an extrusion bump 411.

When the convex surface of the transmission part abuts against the extrusion bump 411, the water diversion seat 41 is pushed in the direction away from the roller 2 by the transmission part, so that the water diversion seat 41 moves in the direction away from the roller 2. In this way, the water outlet end of the water diversion core 42 is separated from the roller 2, and the pigment cannot be delivered to the surface of the roller 2.

Preferably, the cross-sectional shape of the transmission part is fan-shaped, and the cambered surface of the transmission part is an extrusion surface that abuts against and cooperates with the extrusion bump 411.

It should be noted that a plurality of transmission parts may be provided at both ends of the roller 2, and a plurality of transmission parts at the same end are provided around the rotation center of the roller 2 at equal intervals, so as to change the contact frequency between the two water diversion devices 4 and the roller 2, thereby changing the intermittent frequency of the two colors in the lines or patterns drawn by the two-color pen.

The combined shape of the projection surfaces of the plurality of the transmission parts at both ends of the roller 2 is a complete circle.

Preferably, the reset device 5 is a coil spring. A limiting protrusion 412 is provided on the circumferential side wall of the water diversion seat 41. The limiting protrusion 412 is located at one end of the water diversion seat 41 close to the roller 2. The reset device 5 is sleeved on the water diversion seat 41, so that the reset device 5 can be more stably installed on the water diversion seat 41. One end of the reset device 5 abuts against the opening, the other end of the reset device 5 abuts against the limiting protrusion 412, and the reset device 5 is always in a compressed state. The restoring force generated by the restoring device 5 can push the water diversion seat 41 in the direction away from the cavity.

When the convex surface of the transmission part does not abut against the extrusion bump 411, the restoring force generated by the reset device 5 pushes the water diversion device 4 in the direction of the roller 2, and the water outlet end of the water diversion core 42 abuts against the circumferential side wall of the roller 2.

Preferably, the two-color pen further comprises a limiting base 11, wherein the limiting base 11 is inserted into the head of the pen body 1, the limiting base 11 is provided with a perforation at the position corresponding to the water diversion device 4, the water diversion end of the water diversion device 4 is in a rod-shaped structure, the water diversion end of the water diversion device 4 is slidably provided in the water storage device 3 through the perforation, and the water diversion end of the water diversion device 4 is always communicated with the water storage device 3 in the sliding process of the water diversion device 4, so that the pigment in the water storage device 3 can be led to the roller 2 through the water diversion device 4.

the end of the reset device 5 far away from the roller 2 abuts against the limiting base 11.

Preferably, the two-color pen further comprises a fixing seat 12; wherein the fixed base 12 is inserted at one end of the limiting base 11 far away from the pen body 1, two brackets 121 are provided at one end of the fixed base 12 far away from the limiting base 11, and both ends of the roller 2 are rotatably provided on the two brackets 121, respectively, so that the roller 2 is installed more conveniently. The water diversion device 4 is slidably provided between the limiting base 11 and the fixed base 12.

Preferably, the inner side wall of the fixed seat 12 is provided with a chute 122, the length direction of the chute 122 is parallel to the length direction of the pen body 1, the side wall of the water diversion device 4 is provided with a protrusion matched with the chute, and the water diversion device 4 is slidably provided in the fixed seat 12 through the cooperation of the protrusion and the chute, so as to limit the sliding direction of the water diversion device 4. The situation that when the water diversion core 42 abuts against the roller 2, the reaction force generated by the roller 2 to the water diversion core 42 squeezes the water diversion core 42 to the side of the water diversion seat 41 so as to cause the water diversion core 42 to deviate can be avoided, thus making the structure of the two-color pen more stable.

Preferably, the roller 2 has a cylindrical structure, both ends of the roller 2 are provided with rotating shafts 22, the roller 2 is rotatably provided at the head of the pen body 1 through the rotating shaft 22, and the axis of the rotating shaft 22 is perpendicular to the length direction of the pen body 1.

The circumferential side wall of the roller 2 is provided with pattern ribs. The pattern ribs are provided around the circumferential direction of the roller 2. The water outlet ends of the two water diversion devices 4 are in alternate contact with the pattern ribs in sequence.

It should be noted that the above pattern ribs can be linear or wavy. When the pattern ribs are linear, the two-color pen can draw straight lines with two alternating colors. When the pattern ribs are wavy, the two-color pen can draw waves with two alternating colors.

In addition, decorative designs or patterns can also be provided on the pattern ribs, so that the two-color pen can draw patterns with two alternating colors.

Preferably, the two-color pen further comprises a pen cap 6, and the pen cap 6 is detachably sleeved on one end of the pen body 1 provided with the roller 2, so as to better protect the roller 2 and avoid the situation that the lines or patterns drawn by the roller 2 are incomplete due to damage of the roller.

Preferably, a pen point 7 is provided at one end of the pen body 1 far away from the roller 2, a water storage part 8 is provided in the pen body 1, and the water diversion end of the pen point 7 is connected with the water storage part 8.

When the user needs to use an ordinary brush, the user only needs to turn over the pen body 1 and draw patterns or lines with the pen point 7 at the end of the pen body 1 far away from the roller 2, so that the two-color pen is used more conveniently.

Figure 6:
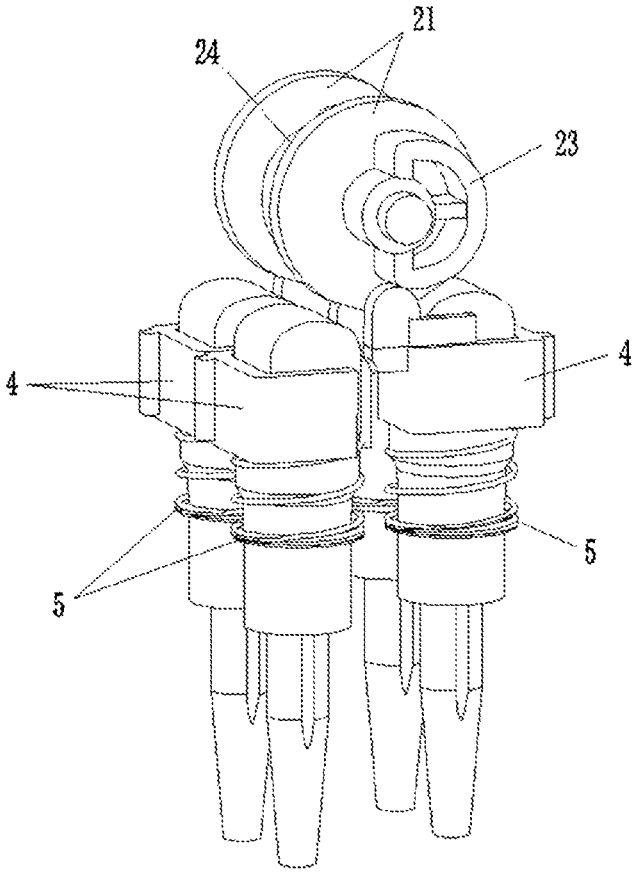
FIG. 6 is a state diagram of a roller of a two-color pen cooperated with a water diversion device according to Embodiment 2.
Figure 7:
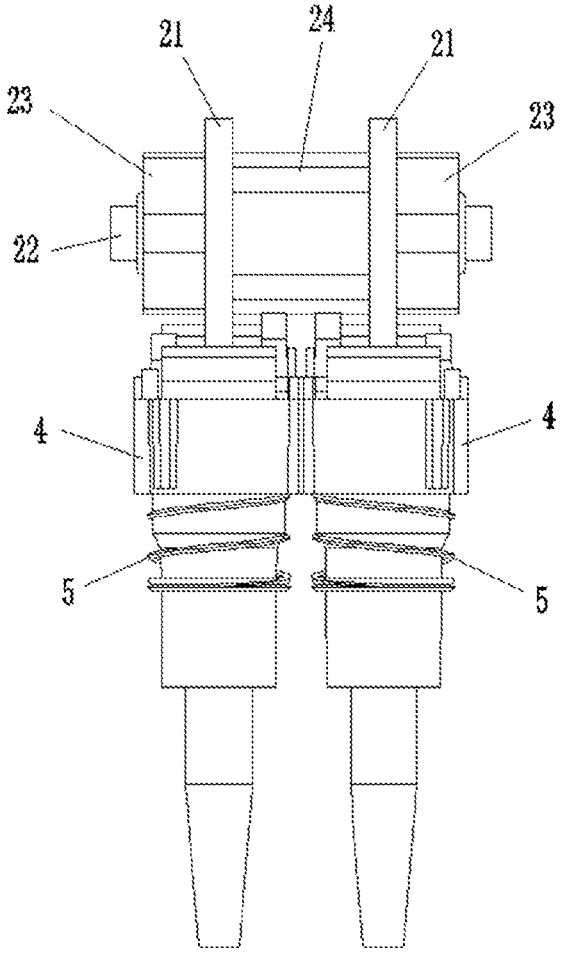
FIG. 7 is a front view when a roller of a two-color pen cooperates with a water diversion device according to Embodiment 2.

Embodiment 2:

As shown in FIG. 1, FIG. 2 and FIG. 4 to FIG. 7:

The present disclosure relates to a two-color pen, in particular to a multi-line two-color pen, which comprises a pen body 1, a roller 2 and water supply components; wherein a cavity is provided in the pen body 1, the head of the pen body 1 is provided with an opening communicated with the cavity; and the roller 2 is rotatably provided at the head of the pen body 1;

there is at least one pair of water supply components, a reset device 5 for pushing the water supply components to be in contact with the roller 2 is provided in the pen body 1; and the roller 2 is provided with a transmission part which alternatively pushes two water supply components in pairs in the direction away from the roller 2 in sequence.

The roller 2 comprises a plurality of line drawing wheels 21, the transmission part comprises two transmission parts A23 and a plurality of transmission parts B24, and the plurality of line drawing wheels 21 are coaxially connected in sequence through the transmission parts B24 to form a line drawing part, the number of the line drawing wheels 21 is equal to the number of pairs of the water supply components, and the two transmission parts A23 are provided at both ends of the line drawing part, respectively.

A plurality of pairs of the water supply components correspond to the positions of the plurality of line drawing wheels 21 one by one, and the transmission parts B24 and the transmission parts B24 or the transmission parts A23 on both sides of the line drawing wheels 21 can alternately push the two water supply components in pairs corresponding to the roller 2 in the direction away from the roller 2 in sequence, so that the water outlet ends of the two water supply components in pairs corresponding to the line drawing wheels 21 can alternately abut against the line drawing wheels 21 in sequence under the action of the reset device 5.

It should be noted that the above number of pairs does not refer to the inverse operation of power in mathematics, but the number of water supply components in pairs.

When the line drawing part is rolling, the transmission part B24 and the transmission parts B24 or the transmission parts A23 on both sides of the line drawing wheels 21 can alternately push the two water supply components corresponding to the line drawing wheels 21 in the direction away from the line drawing wheels 21 in sequence, so that the water outlet ends of the two water supply components can alternately abut against the line drawing wheels 21 in sequence under the action of the reset device 5, so as to facilitate the delivery of the pigment in the water supply components to the line drawing wheel 21 and draw the required positions through the line drawing wheel 21, thus completing drawing a plurality of lines.

It should be noted that the above line drawing wheels 21 can draw lines or patterns of two colors (the two colors are intermittently distributed on the lines or patterns). The line drawing part consisted of a plurality of line drawing wheels 21 can draw a plurality of lines, and the number of lines is equal to that of the line drawing wheels 21.

In addition, the other structures of the two-color pen described in this embodiment are completely the same as those of the two-color pen described in Embodiment 1. Refer to the contents in Embodiment 1 for details, which will not be described in detail here.

The above only describes the specific embodiments of the present disclosure, but the scope of protection of the present disclosure is not limited thereto. Any changes or substitutions conceivable to those skilled in the art within the technical scope disclosed by the present disclosure should be covered within the scope of protection of the present disclosure. Therefore, the scope of protection of the present disclosure should be based on the scope of protection of the claims.

What is claimed is:

1. A two-color pen, comprising a pen body (1), a roller (2) and water supply components;

wherein the roller (2) is rotatably provided at a head of the pen body (1);

there is at least one pair of water supply components, a reset device (5) for pushing the water supply components to be in contact with the roller (2) is provided in the pen body (1); and the roller (2) is provided with a transmission part which alternatively pushes two water supply components in pairs in the direction away from the roller (2) in sequence.

2. The two-color pen according to claim 1, wherein there are two water supply components, the two water supply components are both provided in the pen body (1); the transmission part comprises two transmission parts A (23), the two transmission parts A (23) are provided at both ends of the roller (2), respectively, and the two transmission parts A (23) are in transmission connection with the two water supply components, respectively.

3. The two-color pen according to claim 2, wherein the water supply component comprises a water storage device (3) and a water diversion device (4); the water storage device (3) is fixedly provided in the pen body (1), the water diversion device (4) is slidably provided between the water storage device (3) and the roller (2), and the water diversion end of the water diversion device (4) is always connected with the water outlet end of the water storage device (3).

4. The two-color pen according to claim 3, wherein the water diversion device (4) comprises a water diversion seat (41) and a water diversion core (42); the water diversion seat (41) is slidably provided between the water storage device (3) and the roller (2), the water diversion core (42) is provided on the water diversion seat (41); one end of the water diversion seat (41) facing the roller (2) is provided with an extrusion bump (411) which cooperates with the transmission part.

5. The two-color pen according to claim 4, wherein the cross-sectional shape of the transmission part is fan-shaped, and a cambered surface of the transmission part is an extrusion surface that abuts against and cooperates with the extrusion bump (411).

6. The two-color pen according to claim 5, wherein the reset device (5) is a coil spring, a limiting protrusion (412) is provided on the circumferential side wall of the water diversion seat (41), the limiting protrusion (412) is located at one end of the water diversion seat (41) close to the roller (2), the reset device (5) is sleeved on the water diversion seat (41), one end of the reset device (5) abuts against the head of the pen body (1), the other end of the reset device (5) abuts against the limiting protrusion (412), and the reset device (5) is always in a compressed state.

7. The two-color pen according to claim 6, further comprising a limiting base (11), wherein the limiting base (11) is inserted into the head of the pen body (1), the limiting base (11) is provided with a perforation at the position corresponding to the water diversion device (4), the water diversion end of the water diversion device (4) is connected with the water storage device (3) through the perforation, the end of the reset device (5) far away from the roller (2) abuts against the limiting base (11), and the roller (2) is located at the end of the limiting base (11) far away from the pen body (1).

8. The two-color pen according to claim 7, further comprising a fixed base (12), wherein the fixed base (12) is inserted at one end of the limiting base (11) far away from the pen body (1), two brackets (121) are provided at one end of the fixed base (12) far away from the limiting base (11), both ends of the roller (2) are rotatably provided on the two brackets (121), respectively, and the water diversion device (4) is slidably provided between the limiting base (11) and the fixed base (12).

9. The two-color pen according to claim 8, wherein the inner side wall of the fixed base (12) is provided with a chute (122), the length direction of the chute (122) is parallel to the length direction of the pen body (1), the side wall of the water diversion device (4) is provided with a protrusion matched with the chute, and the water diversion device (4) is slidably provided in the fixed base (12) through the cooperation of the protrusion and the chute.

10. The two-color pen according to claim 9, wherein the roller (2) has a cylindrical structure, both ends of the roller (2) are provided with rotating shafts (22), the roller (2) is rotatably provided at the head of the pen body (1) through the rotating shaft (22), and the axis of the rotating shaft (22) is perpendicular to the length direction of the pen body (1).

11. The two-color pen according to claim 10, further comprising a pen cap (6) for protecting the roller (2), and the pen cap (6) is detachably sleeved on the head of the pen body (1).

12. The two-color pen according to claim 11, wherein a pen point (7) is provided at one end of the pen body (1) far away from the roller (2), a water storage part (8) is provided in the pen body (1), and the water diversion end of the pen point (7) is connected with the water storage part (8).

13. The two-color pen according to claim 1, wherein the roller (2) comprises a plurality of line drawing wheels (21), the transmission part comprises two transmission parts A (23) and a plurality of transmission parts B (24), and the plurality of line drawing wheels (21) are coaxially connected in sequence through the transmission parts B (24) to form a line drawing part, the number of the line drawing wheels (21) is equal to the number of pairs of the water supply component, and the two transmission parts A (23) are provided at both ends of the line drawing part, respectively;

a plurality of pairs of the water supply components correspond to the positions of the plurality of line drawing wheels (21) one to one, and the transmission parts B (24) and the transmission parts B (24) or the transmission parts A (23) on both sides of the line drawing wheels (21) are in transmission connection with two corresponding water supply components in pairs.

* * * * *